US008266741B2

(12) United States Patent
Penninger et al.

(10) Patent No.: US 8,266,741 B2
(45) Date of Patent: Sep. 18, 2012

(54) BED MOVEMENT CESSATION BASED ON IV PUMP ALARM

(75) Inventors: Jason A. Penninger, Indianapolis, IN (US); David W. Hornbach, Brookville, IN (US); Christopher R. O'Keefe, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 142 days.

(21) Appl. No.: 12/853,403

(22) Filed: Aug. 10, 2010

(65) Prior Publication Data

US 2012/0036638 A1 Feb. 16, 2012

(51) Int. Cl.
*A47B 71/00* (2006.01)

(52) U.S. Cl. ..... 5/600; 5/613; 5/940

(58) Field of Classification Search ..... 5/940, 600, 5/622–624, 613, 616–618; 248/51, 52, 74.1; 604/174, 179, 65–67, 246, 30, 31
See application file for complete search history.

(56) References Cited

U.S. PATENT DOCUMENTS

| | | | | |
|---|---|---|---|---|
| 5,400,995 | A | 3/1995 | Boyd | |
| 5,407,163 | A | 4/1995 | Kramer et al. | |
| 5,586,346 | A | 12/1996 | Stacy et al. | |
| 5,611,096 | A | 3/1997 | Bartlett et al. | |
| 6,021,533 | A | 2/2000 | Ellis et al. | |
| 6,358,225 | B1 * | 3/2002 | Butterfield | 604/65 |
| 6,868,740 | B2 | 3/2005 | Hussain | |
| 7,083,150 | B2 | 8/2006 | Newkirk et al. | |
| 7,255,671 | B2 | 8/2007 | Boone et al. | |
| 7,319,386 | B2 | 1/2008 | Collins, Jr. et al. | |
| 7,357,772 | B2 | 4/2008 | McDermott | |
| 7,472,437 | B2 | 1/2009 | Riley et al. | |
| 7,487,562 | B2 | 2/2009 | Frondorf et al. | |
| 7,513,000 | B2 * | 4/2009 | DeBraal et al. | 5/611 |
| 7,538,659 | B2 | 5/2009 | Ulrich et al. | |
| 7,766,289 | B2 | 8/2010 | Newkirk et al. | |
| 2002/0103674 | A1 | 8/2002 | Reeder et al. | |
| 2004/0186341 | A1 * | 9/2004 | McDermott | 600/22 |
| 2007/0181751 | A1 * | 8/2007 | Newkirk et al. | 248/65 |
| 2007/0210917 | A1 * | 9/2007 | Collins et al. | 340/539.1 |
| 2009/0070936 | A1 * | 3/2009 | Henderson et al. | 5/601 |
| 2009/0212925 | A1 | 8/2009 | Schuman, Sr. et al. | |
| 2009/0212926 | A1 | 8/2009 | Du et al. | |
| 2009/0217080 | A1 | 8/2009 | Ferguson et al. | |

OTHER PUBLICATIONS

Service Manual TotalCare® Bed System from Hill-Rom, Product No. P1900, MAN112 Rev 7, 8 pages.
Stryker® Maintenance Manual, *In*Touch™ Critical Care Bed, Model 2130/2140, 2 pages.
Partial European search report from related EP 11 17 7015 dated Nov. 9, 2011, 4 pages.
European Search Report completed Nov. 9, 2011 For corresponding European Application Serial No. 11177015.2.

* cited by examiner

*Primary Examiner* — Robert G Santos
*Assistant Examiner* — David E Sosnowski
(74) *Attorney, Agent, or Firm* — Barnes & Thornburg LLP

(57) ABSTRACT

A bed for use with a patient coupled to a medical device via at least one patient care line is provided. The bed includes a frame including at least one movable patient support section and an actuator coupled to the movable patient support section. The actuator is operable to move the movable patient support section. The bed also includes control circuitry that is coupled to the actuator to command operation of the actuator. The control circuitry ceases operation of the actuator in response to receiving a signal indicative of an unwanted condition of the at least one patient care line.

22 Claims, 5 Drawing Sheets

BED MOVEMENT CESSATION BASED ON IV PUMP ALARM

BACKGROUND

The present disclosure relates to patient support apparatuses such as hospital beds and particularly, to hospital beds having movable mattress support sections for moving a patient to a variety of positions. More particularly, the present disclosure relates to patient support apparatuses used with patients that are connected via patient care lines to medical devices such as IV pumps.

Patients in hospitals are oftentimes connected to various types of medical devices by patient care lines. For example, a patient may receive intravenous (IV) fluids from an IV pump via a tube or hose. As another example, a patient may be connected via wires to a heart monitor such an electrocardiograph (EKG). Patients may be coupled to other equipment such as pulse oximeters, blood pressure monitors, and electroencephalographs (EEG's), via patient care lines. Patients connected to this type of medical equipment are oftentimes supported on hospital beds having pivotable mattress support sections. Such hospital beds have various powered actuators, such as electric linear actuators or hydraulic cylinders, which raise, lower, or otherwise move the mattress support sections to reposition the patient in a desired manner. Such hospital beds may also have motors that raise, lower, and tilt an upper frame that supports the mattress support deck relative to a base frame of the bed.

Hospital beds also typically have siderails along the sides of the bed. IV poles may be coupled to IV pole sockets of the bed on some occasions and carry IV pumps or other types of patient care equipment. Line management devices are sometimes coupled to the IV pole sockets and some IV poles even include line management devices. During articulation or movement of the mattress support sections of the bed, it is possible for the patient care lines to catch on portions of the bed, such as the siderails, or other equipment, and become tensioned inadvertently. In some instances, the patient care lines may become tensioned simply due to running out of slack without catching on anything else. In extreme cases, the lines may become disconnected from the patient or from the associated medical device due to the tensioning of the lines. Sometimes IV lines may become kinked or blocked which typically results in an alarm being generated by the associated IV pump.

SUMMARY

The present invention comprises one or more of the features recited in the appended claims and/or the following features which, alone or in any combination, may comprise patentable subject matter:

A patient support apparatus for use with a patient coupled to a medical device via at least one patient care line is provided and may have a frame including at least one movable patient support section. The patient support apparatus may have an actuator that is coupled to the movable person support section and that is operable to move the movable patient support section. The patient support apparatus may further have control circuitry coupled to the actuator to command operation of the actuator. The control circuitry may cease operation of the actuator in response to receiving a signal indicative of an unwanted condition of the at least one patient care line.

The unwanted condition of the at least one patient care line may comprise unwanted tensioning of the patient care line, kinking of the patient care line such as kinking of an IV fluid line, or blockage of the patient care line such as blockage of an IV fluid line. The signal indicative of the unwanted condition may be communicated to the control circuitry via a wired connection between the patient support apparatus and the medical device. In some instances, the signal indicative of the unwanted condition may be communicated to the control circuitry from the medical device via an Ethernet of a healthcare facility. In some contemplated embodiments, the signal indicative of the unwanted condition may be communicated to the control circuitry via a wireless connection between the patient support apparatus and the medical device. For example, the control circuitry may include an acoustic sensor and the wireless connection may comprise sound waves emanating from an audible alarm of the medical device.

The patient support apparatus may also have a line management device that supports at least a portion of the patient care line. The line management device may, in turn, have a sensor that senses unwanted tensioning of the patient care line to produce the signal. The line management device may have a plurality of upstanding fingers and the sensor may be coupled to at least one of the upstanding fingers. The frame of the patient support apparatus may include a socket. The line management device may have a post configured for receipt in the socket. The post may have a first electrical connector coupled to the sensor and the socket may have a second electrical connector coupled to the control circuitry. The first and second electrical connectors may mate together automatically as a result of insertion of the post into the socket.

In some embodiments, the sensor may be situated between the socket and the post or other coupling portion of the line management device rather than being coupled to a finger of the line management device. For example, the sensor may be mounted to the socket. The coupling portion of the line management device may interact with the sensor within the socket such as by imparting a force on the sensor if a line tugs on the line management device. The sensor may comprise a strain gage or force sensitive resistor element, for example.

The movable patient support section of the patient support apparatus may include a head section, a seat section, a thigh section or a foot section. The actuator may include a head section motor, a thigh section motor, a foot section motor, or an elevation system motor. A mattress may be provided with the patient support apparatus and may have a portion supported on the movable patient support section. The movable patient support section may be part of a patient support deck that is movable between a horizontal position in which the patient is supported in a lying down position and a chair egress position in which the patient is supported in a sitting up position.

By ceasing the operation of the actuator in response to detection of an unwanted condition of the patient care line, disconnection of the patient care line from the patient may be avoided. Patient care lines as contemplated herein, may comprise conduits such as tubes or hoses that carry fluids, including gases and liquids, and may comprise electrical conductors such as wires. The term "medical device" as used in the present disclosure, including in the claims, is intended to cover all types of medical devices that couple to patients with patient care lines. Thus, IV pumps, EKG's, EEG's, blood pressure monitors, pulse oximeters, temperature monitors, respiration monitors, ventilators, heart rate monitors, and the like are examples of medical devices in accordance with this disclosure.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

Figure 1:
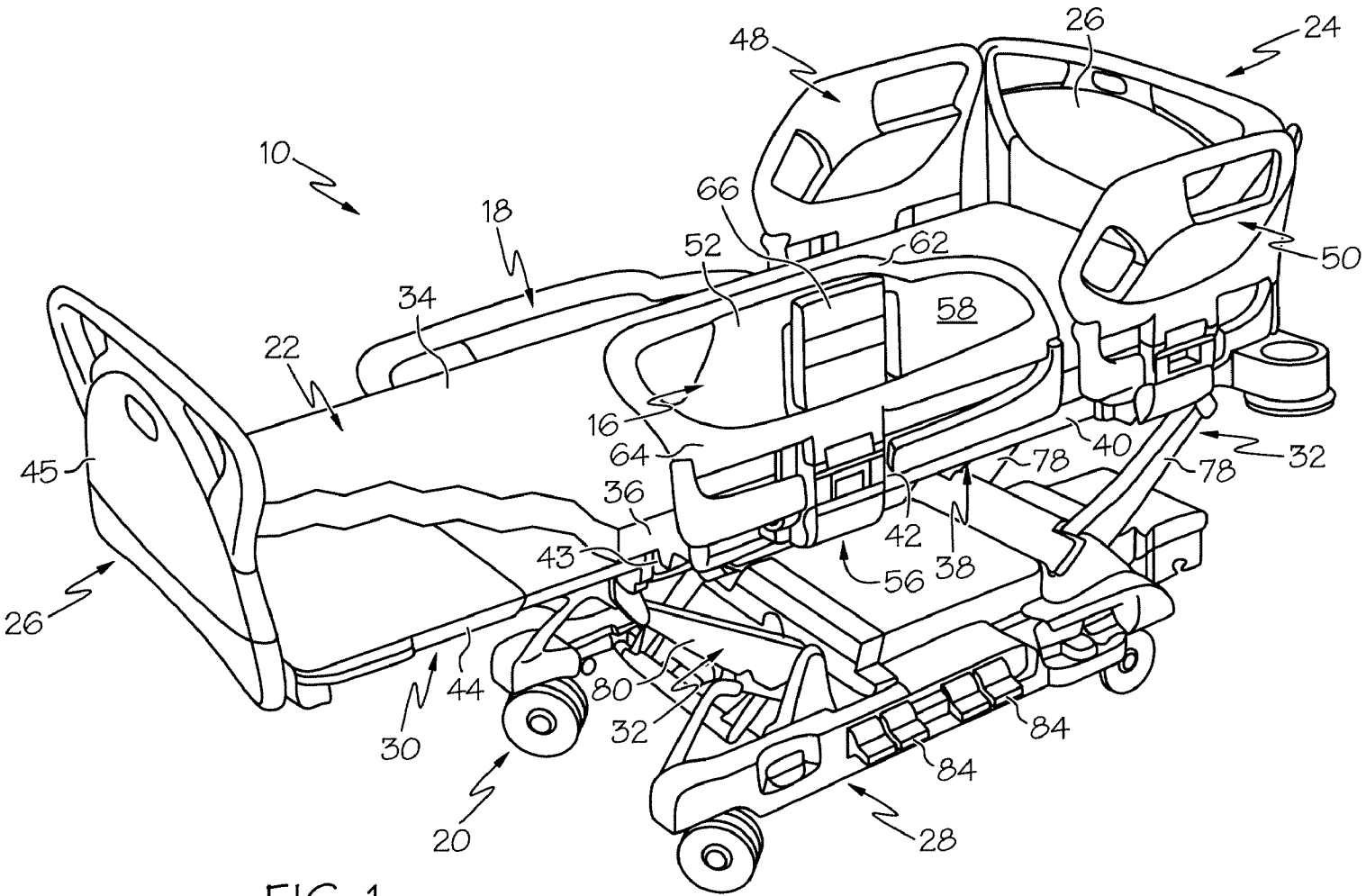
FIG. 1 is a perspective view of a hospital bed showing a bed frame having a patient support deck supporting a mattress in a horizontal position.
Figure 2:
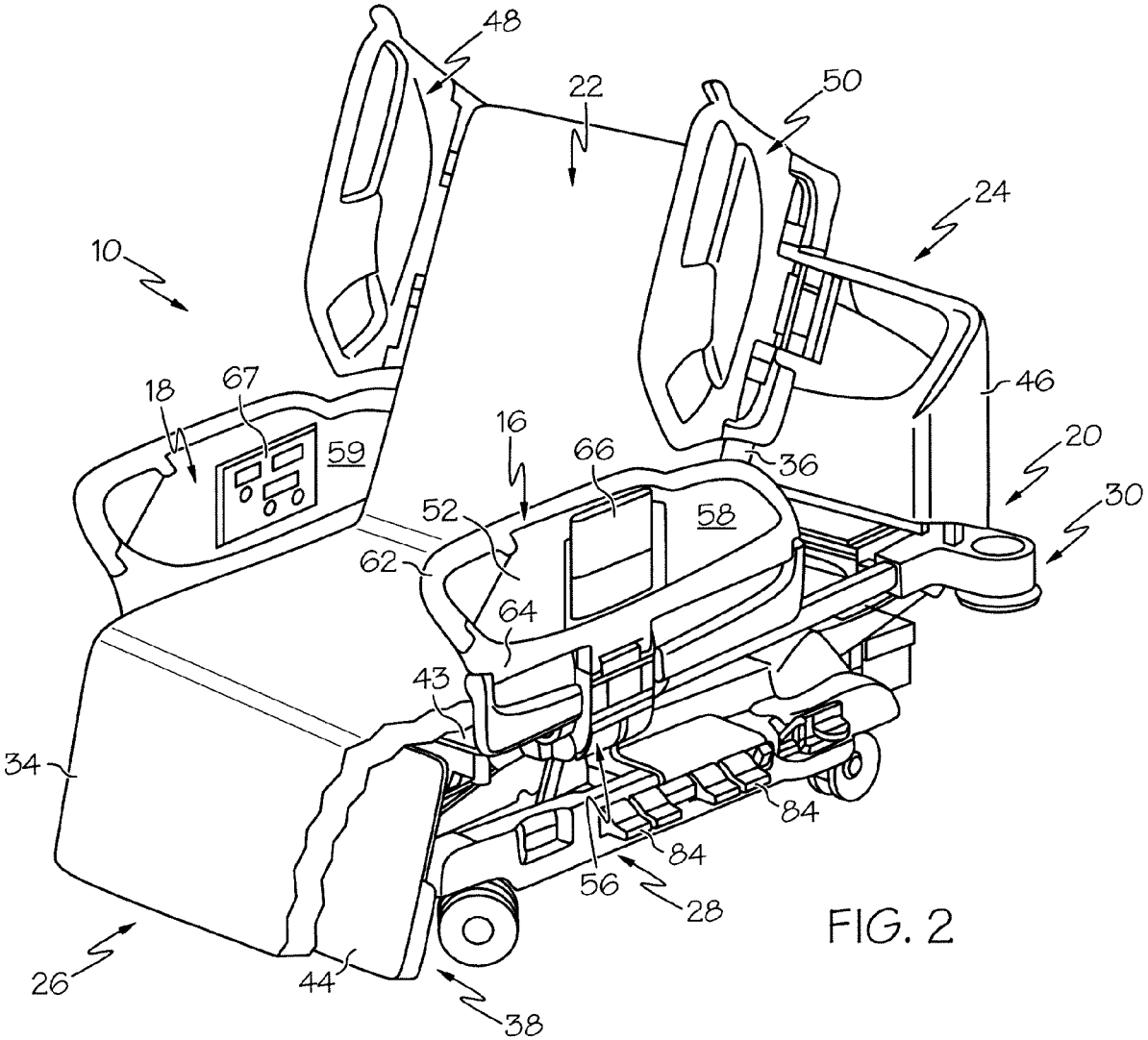
FIG. 2 is a perspective view of the hospital bed of FIG. 1 showing the patient support deck of the bed frame moved to a chair egress position.

According to this disclosure, a patient support apparatus, such as an illustrative hospital bed 10, is configured to stop or cease the movements of at least one of its movable sections in response to receiving a signal indicative of an unwanted condition of a patient care line that is attached to a patient supported on the patient support apparatus. Illustrative bed 10 is a so-called chair bed, in that it is movable between a bed position, as shown in FIG. 1, and a chair egress position as shown in FIG. 2. However the teachings of this disclosure are applicable to all types of hospital beds, including those that are incapable of achieving a chair egress position. Some hospital beds are only able to move into a chair-like position, sometimes referred to by those in the art as a "cardiac chair position," and this disclosure is equally applicable to those types of beds. Furthermore, the teachings of this disclosure are applicable to other types of patient support apparatuses such as stretchers, motorized chairs, operating room (OR) tables, specialty surgical tables such as orthopedic surgery tables, examination tables, and the like.

Referring now to FIGS. 1 and 2, hospital bed 10 provides support to a patient 11 (shown diagrammatically in FIGS. 3-6) lying in a horizontal position when bed 10 is in the bed position. In the chair egress position, hospital bed 10 supports the patient 11 in a sitting position such that the patient sits on bed 10 with the patient's feet positioned on an underlying floor. Thus, the chair egress position is often used by patients and caregivers to help patients egress or exit the hospital bed 10. Hospital bed 10 includes a frame 20 that supports a mattress 22 as shown in FIGS. 1 and 2. Bed 10 has a head end 24 and a foot end 26.

Frame 20 includes a base 28 and an upper frame 30 coupled to the base 28 by an elevation system 32. Elevation system 32 is operable to raise, lower, and tilt upper frame 30 relative to base 28. Hospital bed 10 further includes a footboard 45 at the foot end 26 and a headboard 46 at the head end 24. Footboard 45 is removed prior to bed 10 being moved into the chair egress position as shown in FIG. 2.

Illustrative hospital bed 10 has four siderail assemblies coupled to upper frame 30: a patient-right head siderail assembly 48, a patient-right foot siderail assembly 18, a patient-left head siderail assembly 50, and a patient-left foot siderail assembly 16. Each of the siderail assemblies 16, 18, 48, and 50 is movable between a raised position, as the left foot siderail assembly 16 is shown in FIG. 1, and a lowered position, as the right foot siderail assembly 18 is shown in FIG. 1. Siderail assemblies 16, 18, 48, 50 are sometimes referred to herein as siderails 16, 18, 48, 50.

The left foot siderail assembly 16 is similar to the right foot siderail assembly 18, and thus, the following discussion of the left foot siderail assembly 16 is equally applicable to the right foot siderail assembly 18. The left foot siderail 16 includes a barrier panel 52 and a linkage 56. Linkage 56 is coupled to the upper frame 30 and is configured to guide barrier panel 52 during movement of the foot siderail 16 between the raised and lowered positions. Barrier panel 52 is maintained by the linkage 56 in a substantially vertical orientation during movement of siderail 16 between the raised and lowered positions. The barrier panel 52 includes an outward side 58, an oppositely facing inward side 59, a top portion 62, and a bottom portion 64. A user interface 66 is coupled to the outward side 58 of barrier panel 52 for use by a caregiver (not shown). The inward side 59 faces opposite the outward side 58. As shown in FIG. 2, another user interface 67 is coupled to the inward side 59 for use by the patient 11.

Mattress 22 includes a top surface 34, a bottom surface (not shown), and a perimeter surface 36 as shown in FIGS. 1 and 2. The upper frame 30 carries a patient support deck 38 of frame 20 that engages the bottom surface of mattress 22. The support deck 38, as shown in FIG. 1, includes a head section 40, a seat section 42, a thigh section 43 and a foot section 44. Sections 40, 43, 44 are each movable relative to upper frame 30. For example, head section 40 pivotably raises and lowers relative to seat section 42 whereas foot section 44 pivotably raises and lowers relative to thigh section 43. Additionally, thigh section 43 articulates relative to seat section 42. Also, foot section 44 is extendable and retractable to change the overall length of foot section 44 and therefore, to change the overall length of deck 38.

In some embodiments, seat section 42 also moves, such as by translating on upper frame 30 as bed 10 moves between the bed position and the chair egress position. Of course, in those embodiments in which seat section 42 translates along upper frame 42, the thigh and foot sections 43, 44 also translate along with seat section 42. As bed 10 moves from the bed position to the chair egress position, foot section 44 lowers relative to thigh section 43 and shortens in length. As bed 10 moves from the chair egress position to the bed position, foot section 44 raises relative to thigh section 43 and increases in length. Thus, in the chair egress position, head section 40 extends generally vertically upwardly from upper frame 30 and foot section extends generally vertically downwardly from thigh section 43 as shown in FIG. 2.

Figure 3:
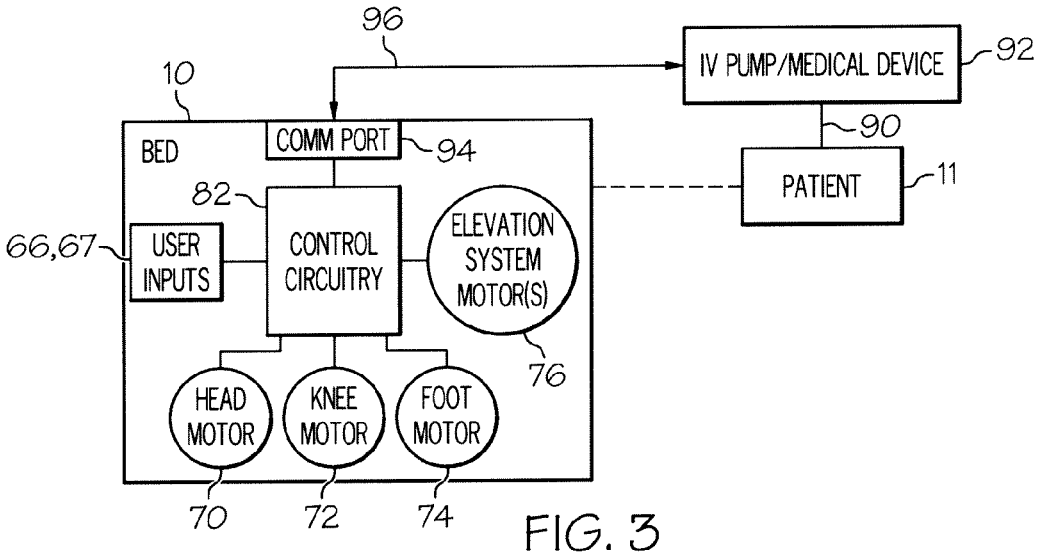
FIG. 3 is a block diagram showing a medical device, such as an IV pump, being coupled to a patient via a patient care line and the medical device being communicatively coupled via a wired connection to the hospital bed.
Figure 4:
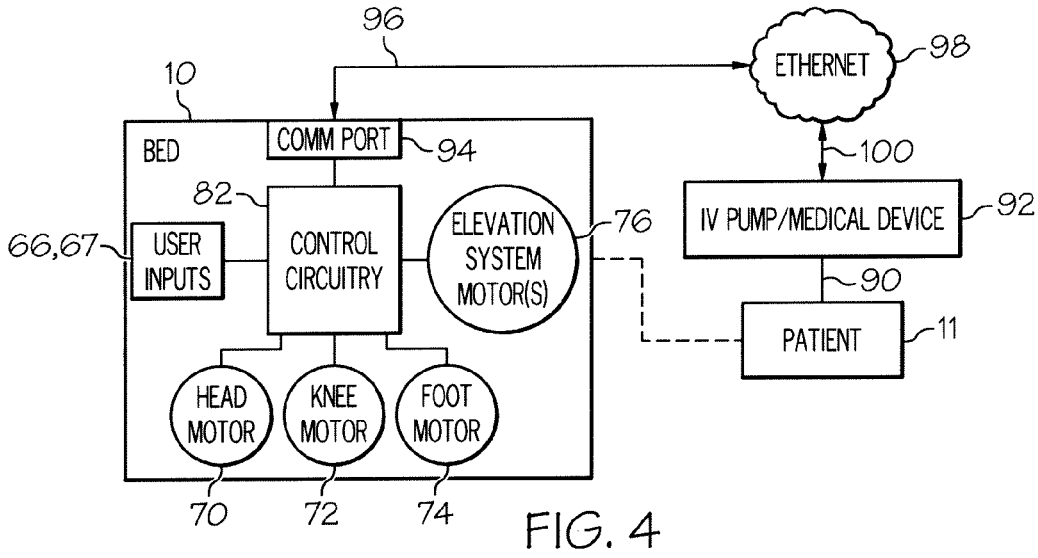
FIG. 4 is a block diagram showing the medical device being coupled to the patient via the patient care line and the medical device being communicatively coupled to the hospital bed via an Ethernet.

As shown diagrammatically in FIGS. 3 and 4, bed 10 includes various actuators, which in some embodiments, comprise linear actuators with electric motors. Alternative actuators contemplated by this disclosure include hydraulic cylinders and pneumatic cylinders, for example. In the illustrative example, bed 10 has a head motor 70 for raising and lowering head section 40, a knee motor 72 for articulating thigh section 43 relative to seat section 42, a foot motor 74 for raising and lowering foot section 44 relative to thigh section 43, and elevation system motors 76 to raise, lower, and tilt upper frame 30 relative to base 20. In some embodiments, bed 10 has an additional motor for extending and retracting one portion of foot section 44 relative to another portion of foot section 44. In the illustrative embodiment, motors 76 act upon a set of head end lift arms 78 and a set of foot end lift arms 80 (only one of which can be seen in FIG. 1) to accomplish the raising, lowering and tilting functions of upper frame 30 relative to base 20. As bed 10 moves from the horizontal bed position of FIG. 1 to the chair egress position of FIG. 2, motors 76 are operated to lower upper frame 30 toward base 20 if frame 30 is in a raised position to begin with.

User interfaces 66, 67 each include user inputs that are used by the caregiver or patient to provide input signals to control circuitry 82 of bed 10 to command the operation of motors 70, 72, 74, 76. User interfaces 66, 67 are sometimes referred to herein as user inputs 66, 67 and are shown diagrammatically in FIGS. 3-5 as user inputs 66, 67. User inputs 66, 67 in one embodiment include for example, a head up button which is used to command motor 70 to raise head section 40, a head down button which is used to command motor 70 to lower head section 40, a knee up button which is used command motor 72 to raise thigh section 43, a knee down button which is used to command motor 72 to lower thigh section, a frame up button to raise upper frame 30 relative to base 28, a frame down button to lower upper frame 30 relative to base 28, a Trendelenburg button to tilt upper frame 30 relative to base 28 into an orientation having the head end 24 lower in elevation than the foot end 26, a reverse Trendelenburg button to tilt upper frame 30 relative to base 28 into an orientation having the foot end 26 lower in elevation than the head end 24, and a chair button which is used to simultaneously operate motors 70, 72, 74, 76 to move bed 10 into the chair egress position. In the illustrative embodiment, a set of foot pedals 84 are coupled to base 28 and are used to operate one or more of motors 70, 72, 74, 76. In other embodiments, foot pedals 84 are omitted.

Based on the foregoing, it will be appreciated that bed 10 has various movable sections including deck sections 40, 42, 43, 44 and upper frame 30. Thus, bed 10 has a variety of movable sections that, on occasion, may inadvertently catch on, pull or tug, kink, or otherwise displace, bend, or tension patient care lines in an unwanted manner while the movable sections are moving. In FIGS. 3-7, one or more patient care lines 90 are illustrated diagrammatically and extend between a medical device 92, such as an IV pump, and patient 11.

According to this disclosure, when an unwanted condition of one or more of patient care lines 90 is detected, control circuitry 82 signals motors 70, 72, 74, 76 to cease operation, thereby to stop any movement of deck sections 40, 42, 43, 44 or upper frame 30 that may be occurring. In the FIG. 3 example, medical device 92 is coupled to a communications port 94 of bed 10 via a communications link 96. Link 96 is a wired communication link in some embodiments and is a wireless communications link other embodiments. Thus, in some embodiments contemplated by this disclosure, bed 10 has a dedicated port 94 that communicates with one or more specific medical devices 92 via link 96. In some such embodiments, when medical device 92 detects an unwanted condition of line 90, the device 92 sends a signal via link 96 to circuitry 82 of bed 10 which, in turn, signals motors 70, 72, 74, 76 to cease operation.

Medical device 92 has one or more sensors (not shown) that detect the unwanted condition of line 90 along with circuitry that is connected to the one or more sensors and that generates an alarm signal which is communicated via link 96 to bed 10. For example, in the situation in which medical device 92 is an IV pump, a flow sensor may be provided for sensing that the flow of IV fluid in the tubular IV line 90 has stopped or is below a threshold amount, which is indicative that line 90 is either blocked or kinked, for example. Additionally or alternatively, a force sensor, such as a strain gage, piezoelectric material, or force sensitive resistor (FSR) may be provided on or adjacent a line connector of device 92 for sensing that line 90 is being pulled or tensioned beyond a threshold amount. Sensors that sense detachment, or impending detachment, of a line 90 from a patient may be included in some medical devices 92. Thus, such a sensor may simply be embodied as software that detects the loss or degradation of an electrical signal such as a signal representative of a physiological parameter of the patient.

Referring now to the example of FIG. 4, port 94 is coupled to medical device 92 via an Ethernet 98. Thus, in this embodiment, communications link 96 couples to Ethernet 98 and medical device 92 couples to Ethernet 98 via a separate communications link 100. Ethernet 98 in FIG. 4 is illustrated diagrammatically and is intended to represent all of the hardware and software that comprises a network of a healthcare facility. Part of Ethernet 98 may comprise a nurse call system; a locating and tracking system; an electronic medical records (EMR) system; and/or an admission, and discharge and transfer (ADT) system, for example.

Communications link 96, in some embodiments, comprises a cable that connects bed 10 to a wall mounted jack that is included as part of a bed interface unit (BIU) or a network interface unit (NIU) of the type shown and described in U.S. Pat. Nos. 7,538,659 and 7,319,386 and in U.S. Patent Application Publication Nos. 2009/0217080 A1, 2009/0212925 A1 and 2009/0212926 A1, each of which are hereby expressly incorporated by reference herein. In other embodiments, communications link 96 comprises wireless signals sent between bed 10 and a wireless interface unit of the type shown and described in U.S. Patent Application Publication No. 2007/0210917 A1 which is hereby expressly incorporated by reference herein. In some embodiments of the FIG. 4 arrangement, when bed 10 ceases operation of one or more of motors 70, 72, 74, 76 in response to receiving a signal from medical device 92 via communications links 96, 100 and Ethernet 98, bed 10 sends an alert message to a nurse call system to notify a caregiver, such as by displaying a message or icon on a display screen of a computer at a master nurse call station, that an unwanted condition of a patient care line 90 has been detected.

Figure 5:
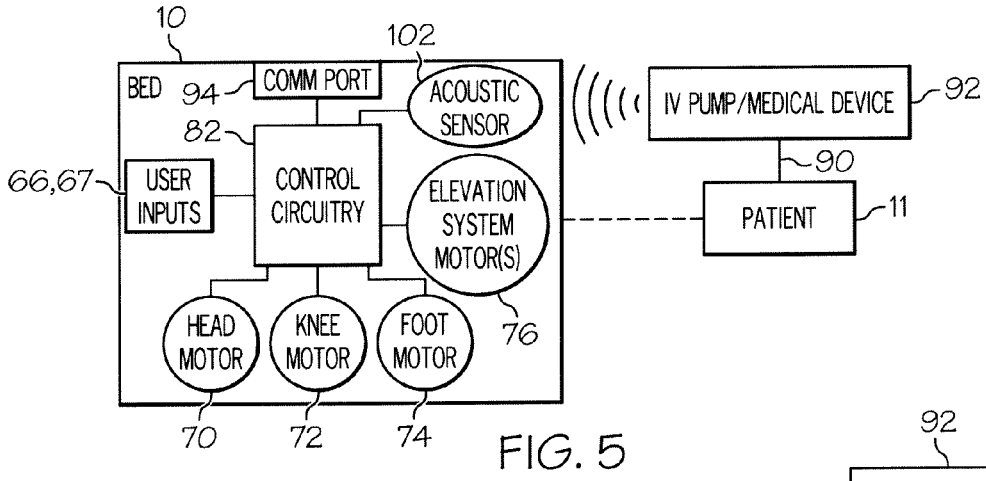
FIG. 5 is a block diagram showing an alternative embodiment of a hospital bed having an acoustic sensor and the medical device communicating wirelessly with the acoustic sensor.

Referring now to FIG. 5, bed 10 has an acoustic sensor 102 that is coupled to control circuitry 82. In this embodiment, when medical device 92 detects an unwanted condition of patient care line 90, an audible alarm of medical device 92 emits sound waves and acoustic sensor 102 detects the sound waves emitted from the alarm of medical device 92. In response to acoustic sensor 102 detecting the sounding of the alarm of medical device 90, circuitry 82 signals motors 70, 72, 74, 76 to cease operation. In the embodiments of FIGS. 3-5, medical device 92 detects the unwanted condition of patient care line 90 and then communicates with bed 10, in one way or another, regarding the unwanted condition.

Figure 6:
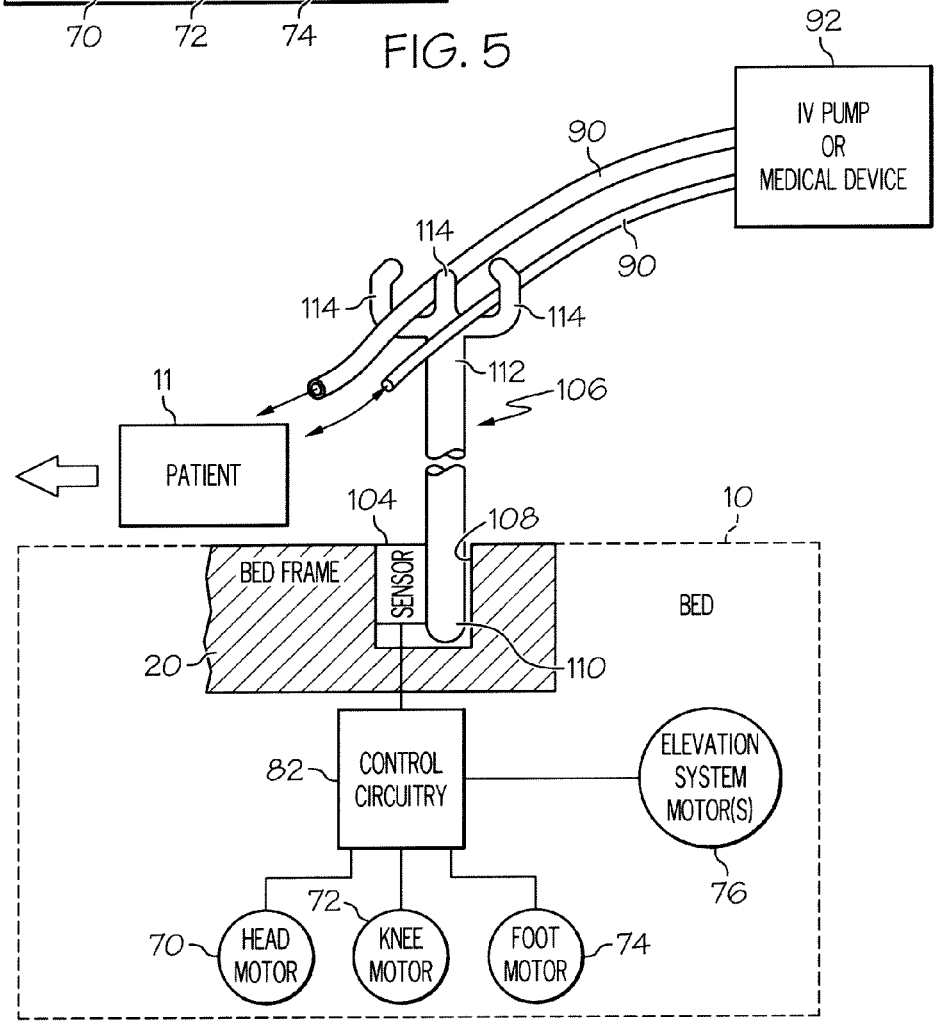
FIG. 6 is a diagrammatic view showing a sensor situated between a bed frame and a line management device and lines from the medical device routed between fingers of the line management device.

It will be appreciated that some medical devices 92 are not equipped with sensors for detecting tensioning of patient care lines 90. In the embodiment of FIG. 6, a sensor 104 is provided between a line management device 106 and bed frame 20. Sensor 104 is electrically coupled to circuitry 82. Frame 20 has a socket 108 that receives a lower end 110 of a vertical post or pole 112 of line management device 106. Sensor 104 is located within socket 108 in the illustrative example. In some embodiments, sensor 104 comprises a strain gage or a force sensitive resistor (FSR) that is attached to the surface that defines socket 108. Sensor 104 comprises other sensor elements, such as a piezoelectric material, in other embodiments.

Patient care lines 90 are routed from medical device 92 to patient 11 between fingers 114 of line management device 106. Thus, line management device 106 supports the patient care lines 90. When one or more of lines 90 become tensioned, they will impart a force on line management device 106 which is detected by sensor 104 and communicated to circuitry 82. If the force detected by sensor 104 exceeds a threshold amount, circuitry 82 signals motors 70, 72, 74, 76 to cease operation.

Figure 7:
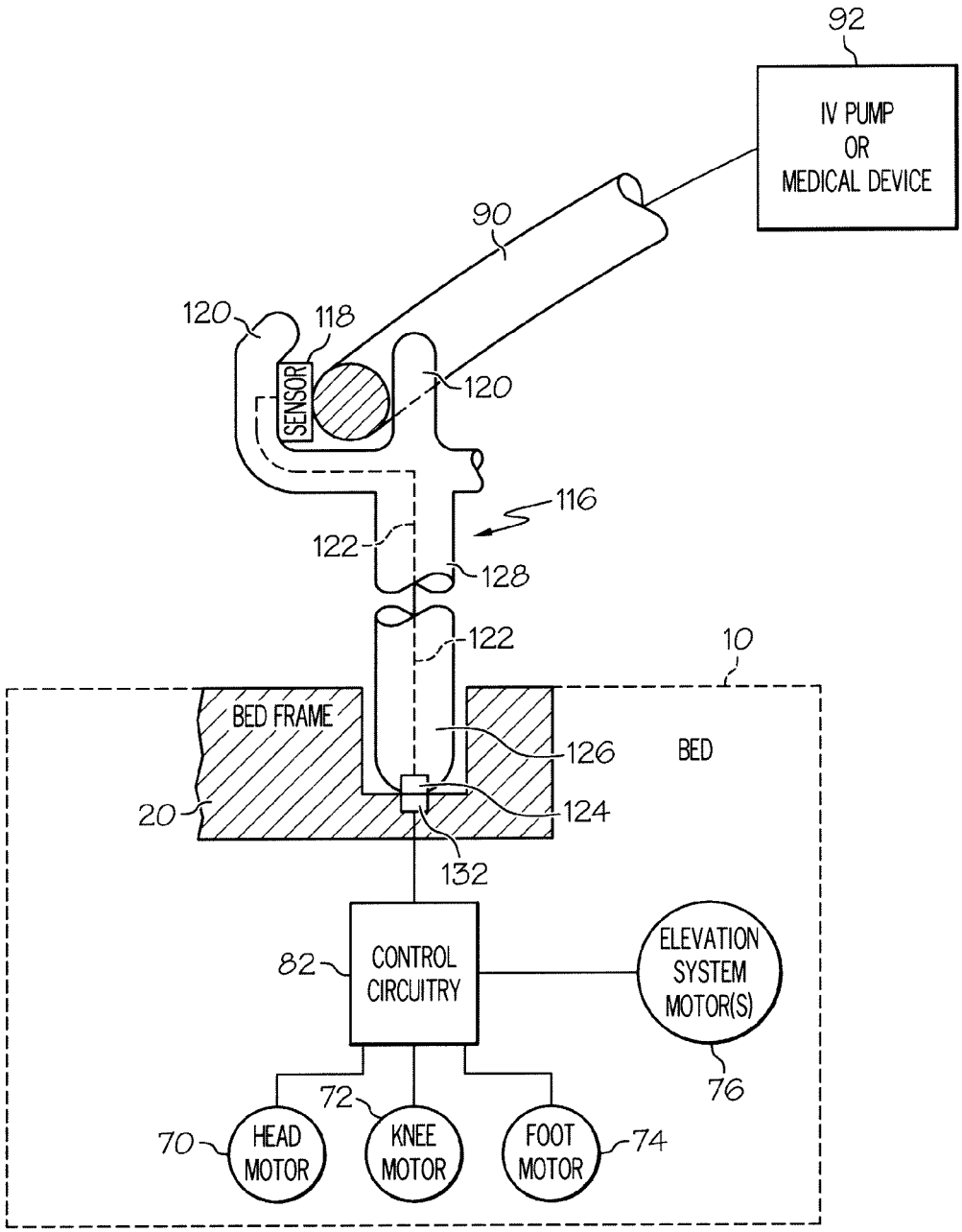
FIG. 7 is a diagrammatic view showing an alternative embodiment in which a sensor is coupled to a finger of a line management device and a set of electrical connectors provide an interface between a post of the line management device and a bed frame of the hospital bed.

Referring now to FIG. 7, an alternative embodiment of a line management device 116 has a sensor 118 mounted to one of a plurality of fingers 120 of line management device 116. In some embodiments, additional sensors are mounted to others of the plurality of fingers 120. In some embodiments, sensor 118 comprises a strain gage or force sensitive resistor (FSR). Sensor 118 comprises other sensor elements, such as a piezoelectric material, in other embodiments. Line management device 116 also has one or more electrical conductors or wires 122 routed through its interior region from sensor 118 to a first electrical connector 124 at the bottom end 126 of a vertical pole or post 128 of line management device 116.

The bottom end 126 of pole 128 is received in a socket 130 of bed frame 20. When end 126 is inserted into socket 130, first electrical connector 124 automatically mates with a second electrical connector 132 that is situated at the bottom of socket 130. Second electrical connector 132 is coupled electrically to control circuitry 82 of bed 10. When one or more of lines 90 supported by line management device 116 become tensioned, they will impart a force on line management device 116 which is detected by sensor 118 and communicated to circuitry 82 via wires 122 and connectors 124, 132. If the force detected by sensor 118 exceeds a threshold amount, circuitry 82 signals motors 70, 72, 74, 76 to cease operation.

In a variant of each of the above-described embodiments, after motors 70, 72, 74, 76 have been commanded to cease operation by control circuitry 82, circuitry commands whichever of motors 70, 72, 74, 76 had been moving prior to receiving the alarm signal from medical device 92 to reverse direction for a short amount of time or distance. By commanding such a reversal of one or more of motors 70, 72, 74, 76, the unwanted condition of line 90 is potentially eased thereby allowing a caregiver to take care of whatever issue is causing the unwanted condition of line 90. For example, if the head motor 70 is being operated to raise head section 40 relative to upper frame 30 when an unwanted tensioning condition of line 90 is detected and communicated to control circuitry 82, the head motor 70 is stopped and then reversed to lower the head section by a small amount, such as for example 1 to 5 degrees, so that the tension in the line 90 is eased. The caregiver can then move the line 90 or the medical device 92. Other ranges of reversal, including ranges having an upper limit greater than 5 degrees and/or ranges having a lower limit less than 1 degree, are within the scope of this disclosure. Different reversal amounts may be used for different ones of motors 70, 72, 74, 76 in some embodiments, including having a reversal amount for some motors 70, 72, 74, 76 and none for others of motors 70, 72, 74, 76.

It will be appreciated that upon detection of the alarm condition of line 90, one portion of control circuitry (such as a portion with a main microcontroller or microprocessor) may signal another portion of control circuitry (such as a motor controller, for example) to reverse the direction of one or more of motors 70, 72, 74, 76 immediately and that the motor control circuitry will respond as quickly as possible, within the parameters of its programming, to stop and reverse the direction of whichever of motors 70, 72, 74, 76 was moving. For at least an instant in time, this control scenario is intended to be within the scope of the phrase "ceasing operation" as well as the situation in which one or more of motors 70, 72, 74, 76 are stopped altogether without the occurrence of any reverse motion. That is, according to this disclosure, whenever a motor or actuator goes from operating in one direction to operating in an opposite direction, the motor or actuator is considered to have been commanded or controlled to be "ceasing operation" regardless of how large or how infinitesimally small the amount of time the particular motor or actuator may actually stop while reversing direction.

Although certain illustrative embodiments have been described in detail above, many embodiments, variations and modifications are possible that are still within the scope and spirit of this disclosure as described herein and as defined in the following claims.

The invention claimed is:

1. A patient support apparatus for use with a patient coupled to a medical device via at least one patient care line, the patient support apparatus comprising a frame including at least one movable patient support section, an actuator coupled to the at least one movable patient support section and operable to move the at least one movable patient support section, a user interface facing away from the patient and that is used by a caregiver to signal operation of the actuator to move the at least one movable patient support section, and control circuitry coupled to the actuator to command operation of the actuator in response to use of the user interface by the caregiver, wherein during movement of the actuator in response to use of the user interface by the caregiver, the control circuitry ceases operation of the actuator in response to receiving a signal indicative of an unwanted condition of the at least one patient care line.

2. The patient support apparatus of claim 1, wherein the unwanted condition of the at least one patient care line comprises unwanted tensioning of the patient care line.

3. The patient support apparatus of claim 1, wherein the unwanted condition of the at least one patient care line comprises kinking of an IV fluid line.

4. The patient support apparatus of claim 1, wherein the unwanted condition of the at least one patient care line comprises blockage of an IV fluid line.

5. The patient support apparatus of claim 1, wherein the signal indicative of the unwanted condition is communicated to the control circuitry via a wired connection between the patient support apparatus and the medical device.

6. The patient support apparatus of claim 1, wherein the signal indicative of the unwanted condition is communicated to the control circuitry via a network of a healthcare facility.

7. The patient support apparatus of claim 1, wherein the signal indicative of the unwanted condition is communicated to the control circuitry wirelessly.

8. The patient support apparatus of claim 7, wherein the control circuitry comprises an acoustic sensor that receives sound waves emanating wirelessly from an audible alarm of the medical device.

9. The patient support apparatus of claim 1, further comprising a line management device that supports at least a portion of the patient care line and the line management device having a sensor that senses unwanted tensioning of the patient care line to produce the signal.

10. The patient support apparatus of claim 9, wherein the line management device comprises a plurality of upstanding fingers and the sensor is coupled to at least one of the plurality of upstanding fingers.

11. The patient support apparatus of claim 10, wherein the frame comprises a socket, the line management device comprises a post configured for receipt in the socket, the post having a first electrical connector coupled to the sensor, and the socket having a second electrical connector coupled to the control circuitry.

12. The patient support apparatus of claim 11, wherein the first and second electrical connectors mate together automatically as a result of insertion of the post into the socket.

13. The patient support apparatus of claim 9, wherein the sensor comprises a strain gage.

14. The patient support apparatus of claim 9, wherein the sensor comprises a force sensitive resistor element.

15. The patient support apparatus of claim 1, further comprising a line management device that supports at least a portion of the patient care line, the frame having a socket configured for receipt of a coupling portion of the line management device therein, and further comprising a sensor situated between the socket and the coupling portion, the sensor producing the signal.

16. The patient support apparatus of claim 15, wherein the sensor is mounted to the socket.

17. The patient support apparatus of claim 15, wherein the sensor comprises a strain gage.

18. The patient support apparatus of claim 15, wherein the sensor comprises a force sensitive resistor element.

19. The patient support apparatus of claim 1, wherein the at least one movable patient support section comprises at least one of a head section, a seat section, a thigh section and a foot section.

20. The patient support apparatus of claim 1, wherein the actuator comprises one of a head section motor, a thigh section motor, a foot section motor, and an elevation system motor.

21. The patient support apparatus of claim 1, further comprising a mattress having a portion supported on the at least one movable patient support section.

22. The patient support apparatus of claim 1, wherein the at least one movable patient support section is part of a patient support deck that is movable between a horizontal position in which the patient is supported in a lying down position and a chair egress position in which the patient is supported in a sitting up position.

* * * * *